United States Patent [19]

Wieland, Jr. et al.

[11] 4,073,668

[45] Feb. 14, 1978

[54] METHOD OF PRODUCING SILICON STEEL STRIP

[75] Inventors: George E. Wieland, Jr.; Eugene M. Rudzki, both of Bethlehem, Pa.

[73] Assignee: Bethlehem Steel Corporation, Bethlehem, Pa.

[21] Appl. No.: 723,365

[22] Filed: Sept. 15, 1976

[51] Int. Cl.[2] ..... H01F 1/04

[52] U.S. Cl. ..... 148/113; 148/27; 148/31.5; 148/100; 148/111; 427/132

[58] Field of Search ..... 148/113, 121, 31.5, 148/27, 110, 112, 111; 427/127, 128, 126, 129, 130, 132

[56] References Cited

U.S. PATENT DOCUMENTS

| | | | |
|---|---|---|---|
| 2,109,485 | 3/1938 | Ihrig | 148/31.5 |
| 3,421,925 | 1/1969 | Hair et al. | 148/112 |
| 3,423,253 | 1/1969 | Ames et al. | 148/113 |
| 3,615,917 | 10/1971 | Shin et al. | 148/111 |
| 3,634,148 | 1/1972 | Shin et al. | 148/111 |
| 3,700,506 | 10/1972 | Tanaka et al. | 148/111 |

*Primary Examiner*—Walter R. Satterfield
*Attorney, Agent, or Firm*—Joseph J. O'Keefe; Johnni Iverson; Robert M. Jones

[57] ABSTRACT

A slurry of ferrosilicon powder is applied to both sides of a low carbon steel strip. The particle size of the ferrosilicon powder is controlled so that, after the slurry coatings are dried, there exists on each side of the steel strip at least a single layer of closely packed particles. The coated strip is then compacted. It is next heated in a protective environment to cause uniform diffusion of silicon throughout the strip.

2 Claims, 2 Drawing Figures

METHOD OF PRODUCING SILICON STEEL STRIP

BACKGROUND OF THE INVENTION

This invention relates to powder metallurgy. More particularly, it relates to a method of producing silicon steel strip by means of powder metallurgy.

It is well known that silicon steel sheet is characterized by electrical properties that render it well suited for fabrication into electrical products such as laminated transformer cores. In the past, silicon steel sheet has been produced by preparing a heat of low carbon steel and adding the desired amount of silicon to the steel either in the molten bath or in the ingot mold into which the heat is poured. The steel is then rolled in several different steps into steel strip of the desired gauge.

Silicon steel strip usually is made to contain from about 0.5 to 6.0% silicon. Steels containing up to about 2.00% silicon can be rolled without undue difficulty. However, steels containing higher amounts of silicon are brittle and difficult to work. Consequently, the production of steel strip containing such higher silicon contents requires heavy mill equipment, small drafts per pass, and frequent annealing between passes. In an effort to obviate these difficulties, efforts have been made to produce silicon sheet by powder metallurgy. For example, low carbon steel strip was first coated with a liquid, e.g., tridecyl alcohol, onto which a silicon-containing powder was supplied by means of brushes rotating in a bed of dry powder positioned beneath the strip. The powder was then compacted onto the strip by rolling. Next, the powder was diffused throughout the strip by means of a heat treatment. Finally, this strip was given a light rolling, to obtain the desired gauge, and heat treated to develop the desired magnetic properties.

Strip produced by this powder metallurgical process was characterized by a nonuniform silicon content because of an inability to provide a uniformly thick coating of powder on the strip surface. In addition, the diffusion time was unduly long.

It is an object of the present invention to provide a method by which an electrical steel sheet having a uniform silicon content is produced. Furthermore, the diffusion treatment time is to be minimum.

It is a further object of this invention to provide a method for producing a product in which an element "*m*" is uniformly diffused throughout a substrate in a minimum time.

SUMMARY OF THE INVENTION

We have discovered that the first of the foregoing objects can be obtained by coating both sides of a low carbon steel substrate with a slurry of silicon-containing powder. The powder comprises particles at least 90% of which have a diameter equal to or less than a value "*d*", in microns, the maximum diameter of the particles being 1.25*d*, where:

$$d = \frac{1.65t\,(\%Si_{pr}) \times 10^7}{(100 - \%Si_{pr})\,(\%Si_p)\,(\rho_p)}.$$

In this formula, $t$ is the thickness of the substrate in inches, $\%Si_{pr}$ is the desired silicon in the final product, $\%Si_p$ is the amount of silicon in the powder, and $\rho_p$ is the density of the powder in grams per cubic centimeter. This slurry is dried on the substrate and the resultant coating is then compacted onto the substrate to obtain a mechanical bond between the powder particles and the substrate. The substrate, with the compacted powder thereon, is then heated for a time and at a temperature sufficient to cause diffusion of silicon throughout the substrate.

In its broader aspects, the subject invention comprises coating both sides of a substrate with a powder containing an element *m*. The powder comprises particles at least 90% of which have a diameter equal to or less than "*d*", in microns, the maximum diameter of the particles being 1.25*d*, where:

$$d = \frac{1.65t\,(\%m_{pr}) \times 10^7}{(100 - \%m_{pr})\,(\%m_p)\,(\rho_p)}$$

In this formula, $\%m_{pr}$ is the amount of element *m* desired in said product, $t$ is the thickness of the substrate in inches, $\%m_p$ is the amount of element *m* in the powder, and $\rho_p$ is the density of the powder in g/cm$^3$.

The slurry is dried on the substrate and the resultant coating is compacted onto the substrate. The substrate, with the compacted powder thereon, is then heated for a time and at a temperature to cause diffusion of the element *m* throughout the substrate.

DESCRIPTION OF THE PREFERRED EMBODIMENT

Figure 1:
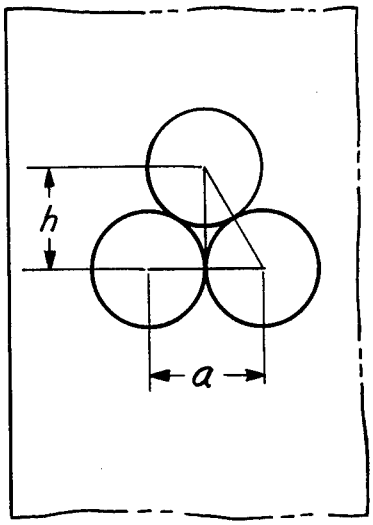
FIG. 1 is a schematic drawing of powder particles on a steel sheet.

The first step in the process of the invention is the preparation of a slurry of silicon-containing powder. Preferably, this slurry is aqueous, although a slurry of an organic liquid, e.g. alcohol, could also be used. The slurry is prepared by mixing about 70% of the powder with about 30% of an aqueous solution of a thickening and binding agent, e.g., a solution of ethyl or methyl cellulose. This agent increases the viscosity of the slurry to about 700 to 25,000 cps.

In order to obtain a minimum diffusion time during the heat treatment step of the subject invention, it is essential that the diameters of at least 90% of the particles of the silicon-containing powder have a diameter equal to or less than "*d*", where:

$$d = \frac{1.65t\,(\%Si_{pr}) \times 10^7}{(100 - \%Si_{pr})\,(\%Si_p)\,(\rho_p)}.$$

In this formula, $t$ is the thickness of the substrate in inches, $\%Si_{pr}$ is the desired silicon in the final product, $\%Si_p$ is the amount of silicon in the powder, and $\rho_p$ is the density of the powder in grams per cubic centimeter. It is also essential that the maximum diameter of the particles is 1.25*d*. Preferably, however, all of the particles have a diameter equal to or less than "*d*".

The diameter *d* was determined in the following manner:

It is assumed that all of the silicon in the powder will diffuse into the steel base sheet onto which it subsequently is applied. In addition, the strip is assumed to be pure iron. Assuming that the silicon-containing powder is ferrosilicon, then the weight of the silicon in the ferrosilicon powder is equal to the weight of the silicon in the final product, viz., the silicon steel sheet.

$$(W_{FeSi})\frac{\%Si_{FeSi}}{100} = W_{pr}\frac{\%Si_{pr}}{100}, \quad (1)$$

where:

$W$ = weight, in grams
FeSi = Ferrosilicon powder
Si = silicon
$pr$ = silicon steel sheet product Equation (1) can be rewritten as:

$$\frac{W_{FeSi}(\%Si_{FeSi})}{W_{pr}(\%Si_{pr})} = 1 \quad (2)$$

Now, the weight of the iron in the product is equal to the weight of the product multiplied by the percentage of iron in the product.

$$W_{Fe} = W_{pr}\left(\frac{\%Fe_{pr}}{100}\right), \quad (3)$$

where:

Fe = iron $$\%Fe_{pr} + \%Si_{pr} = 100, \quad (4)$$

or $$\%Fe_{pr} = 100 - \%Si_{pr} \quad (5)$$

Substituting equation (5) in equation (3) yields:

$$W_{Fe} = W_{pr}\left(\frac{100 - \%Si_{pr}}{100}\right), \text{ or} \quad (6)$$

$$\frac{100W_{Fe}}{W_{pr}(100 - \%Si_{pr})} = 1 \quad (7)$$

Setting equation (7) equal to equation (2) yields:

$$\frac{W_{FeSi}(\%Si_{FeSi})}{W_{pr}(\%Si_{pr})} = \frac{100W_{Fe}}{W_{pr}(100 - \%Si_{pr})}, \text{ or} \quad (8)$$

$$W_{FeSi} = \frac{100W_{Fe}(\%Si_{pr})}{(100 - \%Si_{pr})(\%Si_{FeSi})} \quad (9)$$

It is assumed that the iron in the silicon steel sheet product has all derived from the base steel sheet. That is, the contribution of iron from the iron in the ferrosilicon is negligible. This assumption is valid if the silicon content of the ferrosilicon powder is high. For example, if ferrosilicon containing 90% silicon is used to obtain 5% silicon steel sheet product, the final silicon content of the product will be 5.02%.

The weight of the iron in a sheet of thickness $t$, in inches, and cross-sectional area A, in square centimeters, is:

$$W_{Fe} = (A \times t \times 2.54 \text{ cm/in})(7.83 \text{ g/cm}^3) \quad (10)$$

Substituting equation (10) in equation (9) yields:

$$W_{FeSi} = \frac{1988.82\, A \times t\,(\%Si_{pr})}{(100 - \%Si_{pr})(\%Si_{FeSi})} \quad (11)$$

The volume of the ferrosilicon $V_{FeSi}$, in cm$^3$, is equal to its weight divided by its density, i.e.,:

$$V_{FeSi} = (W_{FeSi}/\rho_{FeSi}) \quad (12)$$

Substituting equation (11) in equation (12) yields:

$$V_{FeSi} = \frac{1988.82\, A \times t\,(\%\,Si_{pr})}{(100 - \%Si_{pr})(\%Si_p)\rho_{FeSi}} \quad (13)$$

Assuming that the powder particles are substantially spherical, the volume in cm$^3$ of each particle is:

$$V = \frac{\pi}{6}(10^{-12})d^3 \text{ where:} \quad (14)$$

$d$ = the diameter of the particles in microns.

$$\text{Number of ferrosilicon particles needed to produce a sheet steel product with the required silicon content} = \frac{\text{Total volume of ferrosilicon required (eq. 13)}}{\text{Volume of single ferrosilicon particle (eq. 14)}}$$

or $$N_1 = \frac{V_{FeSi}}{V} \quad (15)$$

Substituting equations (13) and (14) in (15) yields:

$$N_1 = \frac{3.79837\, A \times t\,(\%Si_{pr})10^{15}}{(100 - \%Si_{pr})(\%Si_{FeSi})(\rho_{FeSi})d^3} \quad (16)$$

It is assumed that the ferrosilicon particles are in a single, tightly packed layer on both sides of the steel sheet. As shown in FIG. 1, the diameter of each particle is "$a$", in cm, and the distance between the centers of particles in a transverse row is also "$a$". The distance between the centerlines of particles in rows longitudinally of the sheet is "$h$", in cm. Then:

$$a^2 = h^2 + (a^2/2) \quad (17)$$

$$a = 10^{-4}d, \quad (18)$$

where $d$ is in microns.

$$h = 0.8660d^{-4} \quad (19)$$

Now, the number of particles $N_2$ required to cover both sides of a sheet metal product equals the number of particles in a row multiplied by the number of rows on a side multiplied by 2.

$$N_2 = 2\,(W/a) \times (L/h), \quad (20)$$

where:

$w$ = the width of the sheet, in cm
$L$ = the length of the sheet, in cm

Substituting equations (18) and (19) in (20) yields:

$$N_2 = (2\,wL/0.8660d^2 \times 10^{-8}) \quad (21)$$

or $$N_2 = (2A/0.8660d^2 \times 10^{-8}) \quad (22)$$

Letting the number of ferrosilicon particles needed to produce a silicon steel sheet product with the required silicon content equal the number of particles required to cover both sides of the steel sheet product, $$N_1 = N_2 \quad (23)$$

Substituting equations (18) and (21) in (23) yields:

$$\frac{3.79837\,A \times t\,(\%Si_{pr})10^{15}}{(100 - \%Si_{pr})(\%Si_{FeSi})(\rho_{FeSi})d^3} = \frac{2A}{0.866d^2 \times 10^{-8}} \quad (24)$$

or $$d = \frac{1.6447 \times 10^7 t\,(\%Si_{pr})}{(100 - \%Si_{pr})(\%Si_{FeSi})(\rho_{FeSi})} \quad (25)$$

Rounding off the constant to $1.65 \times 10^7$ and generalizing the formula to cover any silicon-containing powder yields:

$$d = \frac{1.65 \times 10^7 t\,(\%Si_{pr})}{(100 - \%Si_{pr})(\%Si_{FeSi})(\rho_{FeSi})} \quad (26)$$

Minimum diffusion time is obtained if all of the particles have a diameter equal to or less than "*d*". However, excellent results are obtainable if at least 90% of the particles have a diameter equal to less than "*d*" and the maximum diameter of the particles is 1.25*d*.

Formula (26) may be generalized to cover silicon-containing powders in addition to ferrosilicon powder. Thus:

$$d = \frac{1.65 \times 10^7 t\,(\%Si_{pr})}{(100 - \%Si_{pr})(\%Si_p)(\rho_p)}. \quad (27)$$

Generalizing this formula further to cover the uniform diffusion throughout a substrate of a powder *p* containing an element yields:

$$d = \frac{1.65 \times 10^7\, t\,(\%\, m_{pr})}{(100 - \%m_{pr})(\%m_p)\,(\rho_p)} \quad (28)$$

The base steel sheet is a low carbon steel consisting essentially of about 0.10% max. carbon, 1.00% max. manganese, balance essentially iron. By "balance essentially iron", we do not wish to exclude incidental elements and normal impurities.

Figure 2:
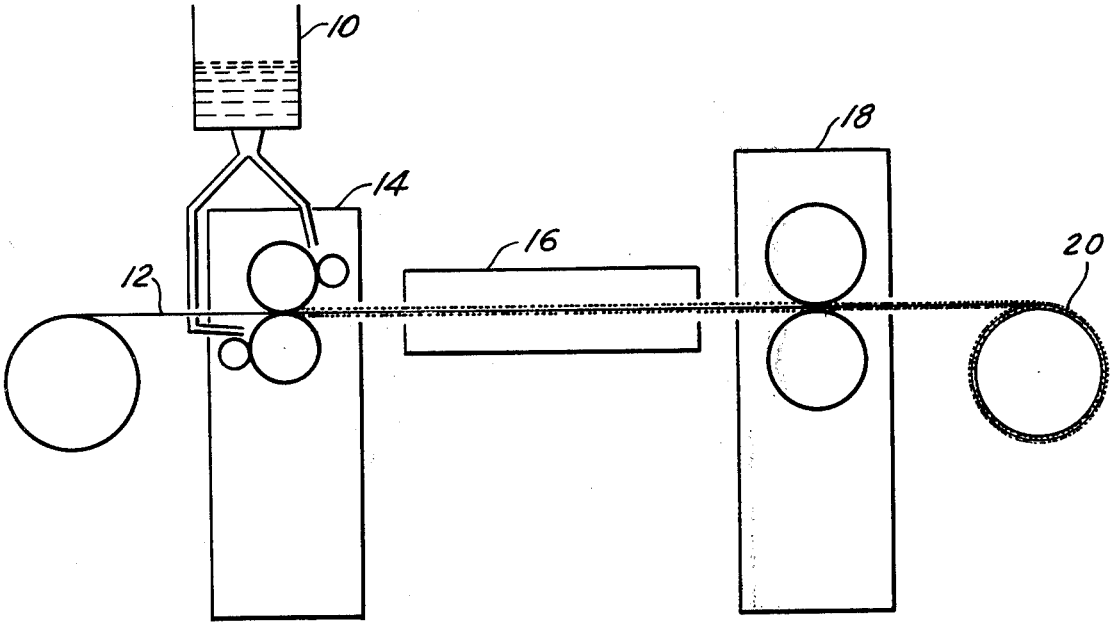
FIG. 2 is a flow sheet of the method of the invention.

As shown in FIG. 2, the powder slurry is mixed in a blending tank 10 and is preferably applied to both sides of a steel strip 12 by means of a reverse roller coater 14. The slurry forms an extremely uniform coating on the strip 12.

The strip 12 is passed through a furnace 16 where the coating is dried on the strip 12 by radiant heat burners. The heat input and the volumetric flow of the air are controlled so that the coating is rapidly dried while the formation of bubbles of steam in the coating is prevented. Typical drying times vary from 0.3 to 1 minute.

The strip 12 is next compacted by passing through the cold rolling mill 18. Preferably, the elongation during compaction should be from 0.5 to 3%.

The compacted strip is coiled on a coiler 20 and is next batch heat treated in a furnace where the strip is heated in a protective environment at a temperature and for a time sufficient to cause a solid state diffusion of silicon from the powder into the strip throughout full thickness of the strip.

The strip may be coiled either loosely or tightly. The furnace atmosphere must be nonoxidizing, reducing, or neutral. Dry hydrogen and NH gas are each satisfactory if the strip is open coiled; however, NH gas is preferred if the strip is tightly coiled since it prevents sticking.

The temperature of the furnace must be at least 875° C and preferably 930° to 1040° C. The minimum time for complete diffusion at 875° C is about 120 hours, whereas shorter times are of course required at higher temperatures.

A brittle layer of iron-silicon intermetallic compounds may be formed on the surface of the strip during the diffusion treatment. However, this layer may be easily removed by brushing the strip.

As a specific example of the invention, a 24 gauge low carbon steel sheet may be coated on both sides with ferrosilicon powder containing 90% silicon and having a density of 2.43 g/cc. At least 90% of the powder particles must have a diameter of 75 microns or less, with none of the particles having a diameter of more than 94 microns.

The coated strip could then be heated in a furnace where the coating would dry in about 0.5 minute. The coated strip next may be reduced by 1% in a cold rolling mill. This strip would then be coiled and placed in a furnace containing NH gas, containing 4% hydrogen, and heated for 100 hours at 1010° C. The resultant product will contain 4% silicon, and the silicon content will be extremely uniform through the cross-section of the strip.

Another product that can be produced by the method of the invention is stainless steel strip. In this case, low carbon steel strip is coated with sufficient chromium or ferrochromium powder that, after the diffusion treatment, the steel strip will contain about 13% chromium uniformly distributed throughout its cross-section.

As used herein, all percentages of elements are expressed in weight percent.

We claim:

1. A method of producing silicon sheet steel comprising:

a. coating both sides of a low carbon steel substrate with a slurry of a silicon-containing powder, at least 90% of the particles of said powder having a diameter equal to or less than *d*, and the maximum diameter of the particles being 1.25*d*, where:

$$d = \frac{1.65t\,(\%Si_{pr})10^7}{(100 - \%Si_{pr})\,(\%Si_p)\,(\rho_p)},$$

in microns, and where *t* is the thickness of the substrate in inches, $\%Si_{pr}$ is the desired silicon in the final product, $\%Si_p$ is the amount of silicon in the powder, and $\rho_p$ is the density of the powder in $g/cm^3$, b. drying said slurry on said substrate to provide a coating, c. compacting said powder particles on said substrate, and d. heating said substrate with the compacted powder thereon in a protective environment for a time and at a temperature sufficient to cause uniform diffusion of silicon throughout said substrate.

2. The method as recited in claim 1, in which all of said powder has a diameter equal to or less than *d*, and the substrate is heated to within the range of 930° to 1040° C during step (*d*).

* * * * *

UNITED STATES PATENT OFFICE

CERTIFICATE OF CORRECTION

PATENT NO. : 4,073,668

DATED : February 14, 1978

INVENTOR(S) : G. E. Wieland, Jr. and E. M. Rudzki

It is certified that error appears in the above-identified patent and that said Letters Patent are hereby corrected as shown below:

Front page, 2nd column, line designating attorney, agent or firm "Johnni" should read --John I.--.

Col. 1, line 31, "supplied" should read --applied--.

Col. 1, line 55, insert the word --a-- before "silicon-containing-

Col. 3, line 56, insert the word --a-- before "5%".

Col. 4, equation 19, should read --$h = .08660d^{10-4}$--. The numeral "10" was omitted.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*